United States Patent [19]

Braude

[11] Patent Number: 4,489,848

[45] Date of Patent: Dec. 25, 1984

[54] BEVERAGE CONTAINER COVER

[76] Inventor: Elton Braude, 41-29 50th St., Woodside, N.Y. 11377

[21] Appl. No.: 372,647

[22] Filed: Apr. 28, 1982

[51] Int. Cl.[3] ..... B65D 41/46

[52] U.S. Cl. ..... 220/90.4; 206/508; 220/331; 229/7 R

[58] Field of Search ..... 220/90.2, 90.4, 268, 220/269, 331; 206/508; 229/7 R

[56] References Cited

U.S. PATENT DOCUMENTS

| | | | |
|---|---|---|---|
| 1,141,462 | 2/1915 | Rucci . | |
| 3,384,265 | 5/1968 | Frank | 206/508 |
| 3,800,999 | 4/1974 | Serritella | 229/7 R |
| 3,905,512 | 9/1975 | Albert et al. . | |
| 3,977,559 | 8/1976 | Lombardi . | |
| 3,994,411 | 11/1976 | Elfelt | 220/90.4 |
| 4,056,210 | 11/1977 | Boyle . | |
| 4,081,103 | 3/1978 | Zoellick | 229/7 R |
| 4,106,660 | 8/1978 | Boyle | 229/7 R |
| 4,106,662 | 8/1978 | Strobe | 220/268 |
| 4,113,135 | 9/1978 | Yamazaki . | |
| 4,202,459 | 5/1980 | DeParales et al. . | |
| 4,210,272 | 7/1980 | Sequin . | |
| 4,215,793 | 8/1980 | Packard . | |
| 4,285,442 | 8/1981 | Wedzik | 229/7 R |
| 4,350,260 | 9/1982 | Prucher | 229/7 R |

FOREIGN PATENT DOCUMENTS

| | | | |
|---|---|---|---|
| W081/01994 | 7/1981 | PCT Int'l Appl. | 220/268 |

*Primary Examiner*—George E. Lowrance
*Attorney, Agent, or Firm*—Albert F. Kronman

[57] ABSTRACT

A one piece cover for a liquid container is scored to outline a tab portion in the top of the cover. Access to the liquid is provided by urging the tab portion upwardly while not disturbing the remainder of the cover. The presence of the cover does not interfere with the generally plannar shape of the cover top so that successive covered containers may be stacked one upon the other. Various tab structures are disclosed which may be opened without the user's fingers coming into contact with the liquid within the container.

2 Claims, 9 Drawing Figures

FIG. 1
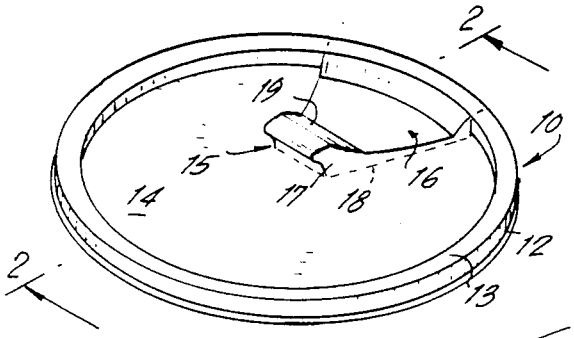
FIG. 2
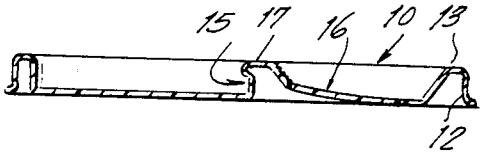
FIG. 3
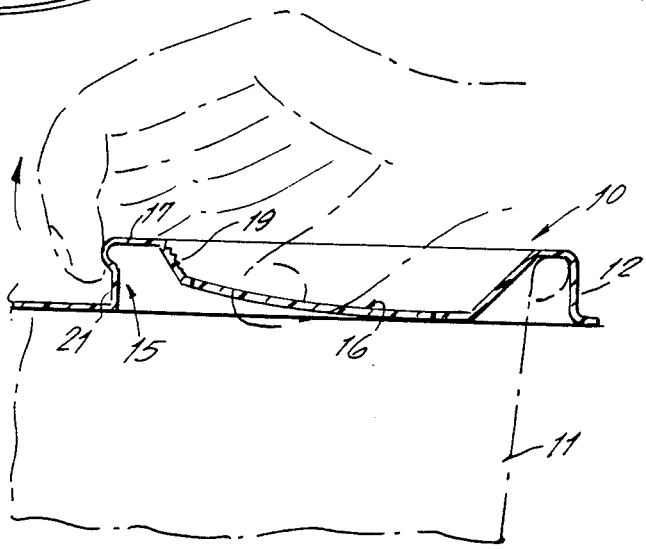
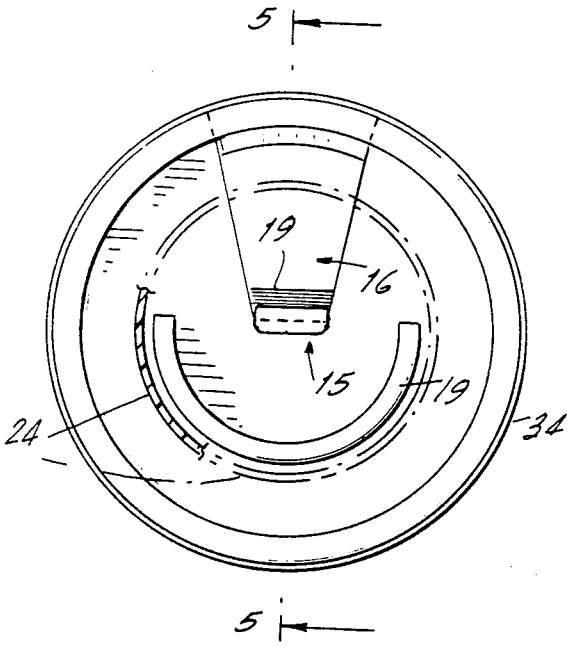
FIG. 4
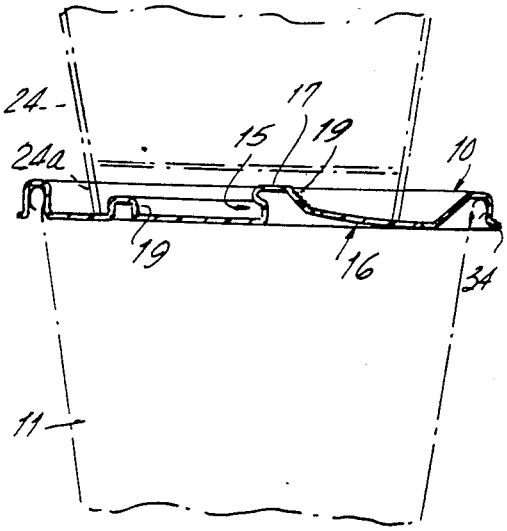
FIG. 5

FIG. 6
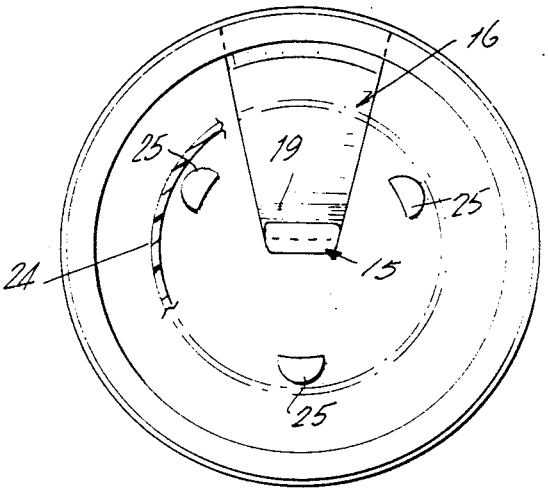
FIG. 7
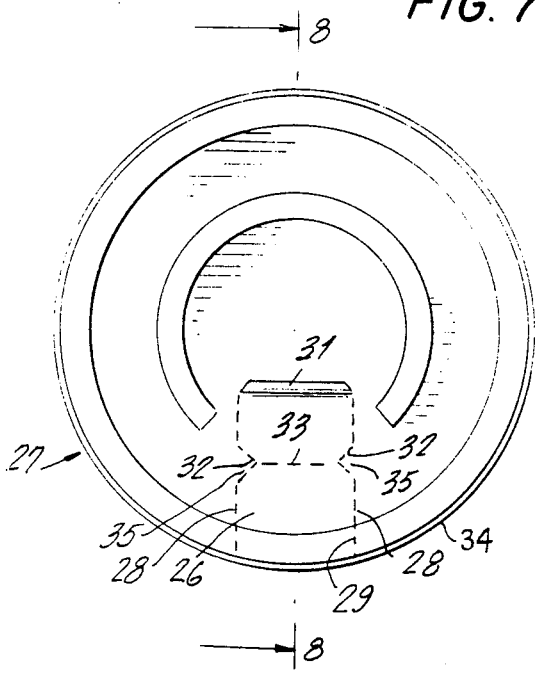
FIG. 8
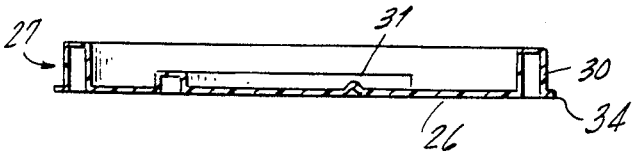
FIG. 10
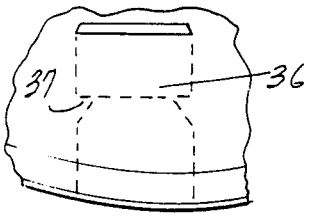
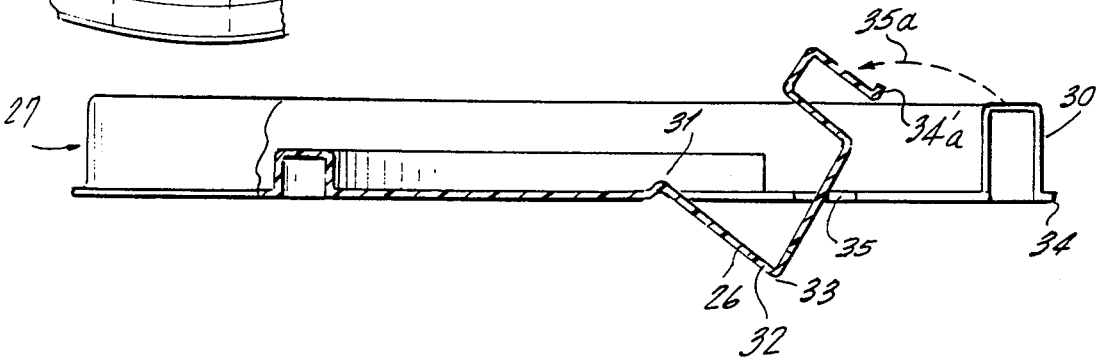
FIG. 9

BEVERAGE CONTAINER COVER

BACKGROUND OF THE INVENTION

This invention relates to covers for disposable containers and the like, such as are made of plastic, paper or combinations thereof. More specifically, the covers are provided with a liftable wedge-shaped tab for the purpose of providing an aperture in the cover, permitting a person to drink from the container without removing the entire cover.

Devices such as are referred to herein are used most often where persons wish to consume beverages while in motion or riding in moving vehicles. Under such circumstances, it has been found that splashing or spilling the beverages from the container can be substantially reduced if most of the opening of the beverage cup remains closed by a cover attached to the top of the cup. Such covers, however, have in many cases been difficult to use since removal of the tab or other cover closure requires substantial manipulation by the user involving two hands and the steadying of the cup at the same time. Removal of the tabs often destroys the good clamping connection between the cover and the container top. In some cases, if the tab is torn away from the cover, the cover is also torn, making it extremely difficult to hold in place.

It is an object of the present invention to provide a cover for a container having a removable tab which can be removed by one hand while the other hand is holding the container in place.

Another object of the present invention is to provide a cover tab which can be removed without forcing it into the liquid within the container.

Still another object of the present invention is to provide a cover tab which can be removed in one piece so that the lips of the user can be applied to the rim of the container which is exposed when the tab is removed.

A further object of the invention is to provide a cover containing a tab which will permit stacking of two or more covered containers.

The above and other objects of the present invention will become apparent by reference to the following specification and drawing;

SUMMARY OF THE INVENTION

A cover made in accordance with the present invention consists of a single sheet of liquid impervious material, preferably plastic, foamed plastic or compressed paper, having a substantially disc-like shape and a flanged portion to slip over and engage the rim of a container, a plannar area on the cover is of a size to receive the base of another container therein for stacking purposes. An embossed portion in the cover, of a substantially wedge shape, is scored to proved lines of weakened structure for tearing purposes. The wedge-shaped embossment having an upstanding portion begins near the center of the cover and diverges outwardly toward the rim of the container. When the user's finger is brought to bear against the upstanding portion of the embossment and squeezed between the user's finger and palm, the tab will snap open along the score lines and may be lifted by the user to provide an aperture for drinking purposes without need for removing the cover.

BRIEF DESCRIPTION OF THE DRAWINGS

In the accompanying description of the drawings forming part hereof, similar elements have been given the same reference numerals, in which drawings;

FIG. 1 is a somewhat isometric view of a container cover made in accordance with the present invention.

FIG. 2 is a cross sectional view taken on line 2—2 in FIG. 1 looking in the direction of the arrows.

FIG. 3 is a fragmentary view of the cover of FIGS. 1 and 2 showing the manner in which the tab is removed.

FIG. 4 is a plan view of a second embodiment of the present invention;

FIG. 5 is a cross-sectional view of the embodiment shown in FIG. 4 taken on line 5—5 in FIG. 4.

FIG. 6 is a top view, of still another embodiment of the present invention.

FIG. 7 is a top view, of a further embodiment of the present invention.

FIG. 8 is a cross-sectional view of the cover shown in FIG. 7 taken on line 8—8.

FIG. 9 is a cross-sectional view somewhat enlarged of the cover of FIGS. 7 and 8 in its articulated or open position.

FIG. 10 is a fragmentary plan view of an alternate form of tab useful in the embodiment of FIGS. 7–9.

DESCRIPTION OF THE PREFERRED EMBODIMENTS

Referring to the drawings and particularly FIGS. 1–3, there is shown a container cover 10 made of plastic, paper or other suitable material having a substantially disc-like shape and of a diameter which will permit it to be slipped over the rim of a container 11. The cover 10 is provided with a downwardly extending flange 12 which overlies the rim of the container 11, in the well-known manner, to confine the contents of the container and prevent spilling. The flange 12 is part of a circular bead 13 which is of a depth and width sufficient to frictionally engage the rim of the container. In normal use, the container 11 will be filled with a liquid and the cover 10 pressed down securely upon the rim of the container in the manner shown in dashed lines in FIG. 3.

The top of the cover 10 is substantially plannar as indicated at 14. This top portion may also be recessed with respect to the bead 13 so as to lie below the top of said bead.

An upwardly embossed portion 15 is provided in the top 14 of the cover 10 and is preferably wedge shaped to define a tab 16. The inner end 17 of tab 16 is disposed above the recessed top 14 as shown in FIGS. 1–5. The remainder of the tab is co-planner with or at a slight angle from the recessed top 14 (see FIG. 3). The tab construction improves the removal of the tab without interfering with the stacking of the cover 10 when desired.

The embossed portion 17 is scored as indicated by the dashed lines 18 in FIG. 1 to provide weakening areas in the material of the cover 10. The scoring 18 extends outwardly from the center of the cup to the periphery of the cover, over the edge of the cover and along the flange 12.

The embossed portion 17 of the tab 16 closest to the center of the lid may be provided with small raised rib-like transverse serrations 19 as shown in FIG. 3. These serrations aid in lifting the tab 16 from the cover as hereinafter more fully described.

The operation of the cover 10 shown in FIGS. 1–3 will be apparent by an examination of FIG. 3. In order to remove the tab 16 for access to the liquid within the container, the user places one hand upon the top of the lid in the manner indicated at 20 in dashed lines. The edge of the cover 10 is supported by the palm of the hand and one finger such as the index finger or second finger brought to bear against the small flattened end 21 of the raised embossed portion 17. The flattened end 21 is then gently pulled upward and toward the edge of the container in the direction of the palm of the user's hand. The raised embossed portion 17 will then snap open around the end 21 permitting the tab 16 to be lifted without the user's fingers coming in contact with the liquid within the cup. The tab 16 can then be torn along the scope lines 18 until it is completely removed from the cover 10. The remainder of the cover will be retained upon the edge of the container and the liquid can be imbibed through the opening provided by the removal of the tab.

Alternately, the user can grasp the raised embossed portion 17 by using the index finger and thumb bearing against the serrations and flattened end 21. By pinching the raised embossed portion, thus held the raised portion 17 can be snapped open and the tab 16 removed.

Referring to FIGS. 4 and 5, there is shown another embodiment of the present invention in which an arcuate rib 22 is formed on the top of the plannar top 14 of the cover 10. The rib 22 terminates short of the area defined by the tab 16 so that the bottom flange flange 23 of another container, shown in dashed lines 24 can be received either around or within the said rib. The support of the rib 22 together with the planner shape of the cover 14 permits the stacking of covered containers. In all other respects, the operation of this embodiment is similar to that previously described in connection with FIGS. 1–3.

The embodiment of FIG. 6 shows the use of a plurality of upstanding detents 25 located in spaced relationship upon the flattened portion 14 of the cover 10. The detents are somewhat semicircular in shape so that they act to frictionally engage the bottom flange 24A of a container stacked thereon. This engagement may be on the inside of the container flange, as shown in FIG. 6 or on the outside of the flange 24A depending on the size and shape of the said container flange.

FIGS. 7–10 show a further embodiment of the present invention in which the tab 26 is captive to the cover 27 in that the tab 26 is not removed from the cover in order to drink from the container. In this embodiment, the tab 26 is defined by score lines 28 in the cover 27 as best shown in FIG. 7. The sides 29 of the tab 26 are preferably parallel as shown and the score lines 28 continue to the periphery of the flange 30.

A short transverse area 31 hereinafter referred to as the hinge is provided on the tab 26 by ending the side score lines 28 at their innermost extremities. Spaced notches 32 are created in the tab 26 by indenting the side score lines 28. A weakened line (hereinafter referred to as a fold line 33) and indicated by dashed lines in FIG. 7 is provided for between the notches 32.

The operation of the embodiment of FIGS. 7–9 is best shown in FIG. 9.

In order to gain access to the contents of liquid within a container to which the cover 27 has been attached, the user grasps the peripheral end of the tab at 34 and lifts it in the manner shown in dashed lines at 35*a*. The tab breaks loose along the side score lines 28 and is forced upwardly causing it to buckle along the hinge 31 and the fold line 33. Continuing to force the folded tab toward the center of the cover will result in the tab becoming secured behind the opposed extensions 35 formed as a result of the notches 32. The tab may then be released and will remain in the position indicated at 35*a* while the user can drink from the container through the aperture provided in the cover tab. This embodiment overcomes one of the objections to cover tabs in that it is not thrown away by the user but remains captive on the cover at all times. The tab may be used to cover the aperture, at least partially by being pulled back into its original location in the event that the user is interrupted in drinking from the container. The simplified construction of the tab 26 also permits stacking of containers one upon the other after they are filled which is a desirable feature when several containers of liquid are placed within the same bag and carried about.

The embodiment shown in FIG. 10 is similar to that of FIGS. 8 and 9 except that the tab 36 is provided with a buttress shaped notch 37 which makes the engagement between the tab and the sawtooth projections on the sides of the aperture formed when the is raised more positive.

Having thus fully described the invention what is desired to be secured by Letters Patent is:

1. A unitary cover for a container having an opening at its top and a rim surrounding said opening comprising a substantially planar disc-shaped member, a substantially flat top portion on said cover to overlie the container opening, a peripheral flange integral with and depending from the top portion to embrace the container rim, a captive tab portion in said top integral with said top, spaced top weakening score lines in the top portion extending partially across the top portion and ending at the outer edge of the peripheral flange to define the sides of the tab, said score lines being spaced from each other in substantially parallel orientation and terminating substantially at the center of the top, a hinge normally disposed between said spaced score line ends near the center of the top, a transverse fold line spaced from the hinge and between the score lines, opposed indented portions in said score lines to define inwardly directed extensions of said top when the end of the tab portion in the peripheral flange is lifted, and when the tab is raised leaving an access opening in the cover with said opening having said inwardly directed extensions disposed in the path of the tab portion as it is raised, whereby the tab can be moved about said hinge and folded along said transverse fold line so that the free end of the tab can be retained in the open position by said inwardly directed extensions.

2. A cover according to claim 1 in which the said indented portions are buttress shaped.

* * * * *